US010526058B2

(12) United States Patent
Choudhury

(10) Patent No.: US 10,526,058 B2
(45) Date of Patent: Jan. 7, 2020

(54) BALLAST AND DE-BALLAST SYSTEM AND METHODS

(71) Applicant: Crowley Technical Services, Jacksonville, FL (US)

(72) Inventor: Jayant K. Roy Choudhury, Jacksonville, FL (US)

(73) Assignee: Crowley Technical Services, Jacksonville, FL (US)

( * ) Notice: Subject to any disclaimer, the term of this patent is extended or adjusted under 35 U.S.C. 154(b) by 0 days.

(21) Appl. No.: 15/696,988

(22) Filed: Sep. 6, 2017

(65) Prior Publication Data

US 2019/0071156 A1 Mar. 7, 2019

(51) Int. Cl.

| | |
|---|---|
| ***B63B 39/03*** | (2006.01) |
| ***B63B 43/06*** | (2006.01) |
| ***B63B 9/08*** | (2006.01) |
| ***B63B 43/08*** | (2006.01) |
| ***B63B 35/66*** | (2006.01) |
| ***B63B 35/28*** | (2006.01) |

(52) U.S. Cl.

CPC ..... *B63B 39/03* (2013.01); *B63B 35/28* (2013.01); *B63B 35/66* (2013.01); *B63B 2207/02* (2013.01)

(58) Field of Classification Search

CPC ..... B63B 39/03; B63B 35/66; B63B 35/70; B63B 35/28; B63B 2207/00; B63B 2207/02; B63B 21/56

USPC ..... 114/242, 248, 249, 252, 121, 125

See application file for complete search history.

(56) References Cited

U.S. PATENT DOCUMENTS

| | | | | |
|---|---|---|---|---|
| 6,199,501 | B1 * | 3/2001 | Kuhlman | B63B 35/665 114/248 |
| 7,776,222 | B2 * | 8/2010 | Glessner | C02F 1/001 114/125 |
| 8,844,459 | B2 * | 9/2014 | Perez | B63B 35/70 114/144 RE |
| 8,967,174 | B1 * | 3/2015 | Perreault | B63B 21/56 137/1 |
| 9,598,152 | B2 * | 3/2017 | Perreault | B63B 21/56 |
| 2008/0283467 | A1 * | 11/2008 | Nguyen | B63B 35/00 210/600 |
| 2010/0000252 | A1 * | 1/2010 | Morris | B63B 27/24 62/611 |
| 2012/0226636 | A1 * | 9/2012 | Perez | B63B 35/28 705/500 |
| 2012/0324810 | A1 * | 12/2012 | Poirier | E06B 1/68 52/204.1 |
| 2014/0290281 | A1 * | 10/2014 | Waller | F17C 1/002 62/53.2 |
| 2015/0274262 | A1 * | 10/2015 | Perreault | B63B 21/56 137/899.2 |

(Continued)

*Primary Examiner* — Daniel V Venne

(74) *Attorney, Agent, or Firm* — Venable LLP; Michele V. Frank

(57) ABSTRACT

A ballast and de-ballast system and method for an articulated tug barge (ATB) or integrated tug barge (ITB) are described herein. The system includes a tug ballast tank located on the tug, the tug ballast tank being configured to hold ballast water; and a barge trim tank located on the barge, the barge trim tank being configured to hold ballast water. The system further includes at least one umbilical line connecting the tug ballast tank to the barge trim tank. The system is configured to transfer ballast water between the tug ballast tank and the barge trim tank via the at least one umbilical line.

16 Claims, 3 Drawing Sheets

(56) References Cited

U.S. PATENT DOCUMENTS

2018/0015988 A1* 1/2018 Perreault ..... B63B 21/56

* cited by examiner

BALLAST AND DE-BALLAST SYSTEM AND METHODS

FIELD

The present invention relates to Articulated Tug and Barge (ATB) and Integrated Tug and Barge (ITB) type vessels in general, and in particular to the ballast and de-ballast system for these vessels.

INTRODUCTION

A ship or vessel (used interchangeably herein) is often provided with a ballast system used to manage the stability of the ship or vessel. Such a ballast system is often provided in the form of one or more compartments or chambers, referred to as "ballast tanks," a pumping unit referred to as a "ballast pump" and a network of piping and valves interconnecting the ballast tanks and ballast pump(s) and in total is referred to as a "ballast water system." During a ballast operation water is either pumped in or out of the ballast tank(s) to compensate for loads being added or removed from the ship, such as fuel, which are normal events occurring on ships. The additions, removal and redistribution of loads are necessary to maintain the vessel in a safe and stable condition. The ballast water may be redistributed in the ship, added to the ship commonly referred to as "ballasting," or removed from the ship commonly referred to as "de-ballasting" to modify its effect on the stability of the ship. However, problems have occurred when the ballast water pumped into ballast tanks in one geographical area of the globe is discharged in another geographical area of the globe, as water-borne organisms transported in the ballast water can create havoc when deposited in new environments.

Ballast water management regulations were formulated to protect the marine environment from the introduction of invasive organisms originating from distant locations. Originally the regulations were intended for ships carrying large quantities of ballast water (along with invasive species) across the oceans. Ballast Water Treatment Systems (BWTS) were developed to meet the new regulations but were focused on large vessels with long trip durations. Tug boats (referred to also as a "tug"), have much smaller ballast systems, but are subject to the same ballast water management regulations. Technology's focus has been toward larger ocean going vessels and not fine-tuned to meet the operational challenges of the smaller vessels with short trip durations.

A "tug boat" is a powerful boat that is used for towing larger vessels and in the case of an ATB or ITB the tug operates in tandem with a larger vessel, a barge. The regulators provided various options for dealing with invasive organisms found in ballast water primarily treating ballast water to kill the invasive organisms. However, ballast water treatment equipment are not well suited or have limited applicability for smaller vessels like tug boats. The use of "clean ballast water" such as potable water as a ballasting medium would alleviate the need to "treat" the ballast water. Additionally the regulations allow for transferring ballast water to and from a shore side facility eliminating the possibility of ballast water being introduced into the local environment. However, as currently envisioned in the regulations, these two options are either limited or unsuitable due to a tug boat's size and operational requirements. Potable water in large quantities (even 200 $m^3$ to 300 $m^3$) is often not available in many of a tug boat's port of call or even if available would not fulfill the requirement for the necessary underway ballasting operations. Utilization of a shore based facility, which are virtually non-existent in many U.S. ports, to transfer ballast water has the same operational restriction as the potable water solution especially the requirement for underway operations.

An Articulated Tug Barge includes a tank vessel (barge) and a relatively large, powerful tug boat that is positioned in a notch in the stern of the barge, which enables the tug to propel and maneuver the barge. Unlike an Integrated Tug/Barge, where the tug boat and barge are locked together in a rigid connection, and become for practical purposes one unit, the ATB has an articulated or "hinged" connection system between the tug and barge. This allows movement in one axis, or plane, in the critical area of fore and aft pitch. An ATB Tug requires frequent ballast/de-ballast operations while underway. In addition, the tug has limitations of manning and ballast pump flow rates, which makes conventional ballast water treatment systems unsuitable for ATB tugs. As discussed below, the current U.S. Coast Guard (USCG) approved systems, due to the limitations imposed on their Test Certificates, are not suitable for most ATBs.

There are currently four ballast systems approved by the USCG (manufactured by Optimarin, Alfa-Laval, Sunrui, and Oceansaver) but all four systems have significant operational limitations in various parameters. A first parameter is salinity, in that the vessels frequently go to fresh water ports and salinity restriction will lead to operational challenges on-board. A second parameter is the ballast pump capacity. Often the tug's ballast pump has insufficient capacity to meet the minimum flow required to provide cooling for systems utilizing UV lamps to treat ballast water. A third parameter is temperature limitations of ballast water before treatment. Tugs work across all temperature ranges from tropic to artic regions, hence any limitation on ballast feed stock can be challenging. A fourth parameter is hold time of ballast water. Some systems require ballast water, once treated, to be retained in the ballast tanks for a minimum duration before it can be discharged, the minimum hold time is critical for vessels where transit time (between ports) is short. A fifth parameter is ballast pump discharge pressure. Most systems require a minimum ballast pump pressure to facilitate back flushing the system filter, based on experience with ATB tankers, this would be critical parameter for vessels with deck mounted units. A sixth parameter is available tug electrical power. The tug may not have adequate reserve electrical power to support ballast water treatment solutions utilizing high intensity ultraviolet (UV) lamps used to treat the ballast water. Based on limitations in one or more of these parameters, each of the current USCG-approved ballast systems has limited use with ATB tugs. These limiting factors render the installation and operation of ballast water treatment systems on board ATB tugs very challenging. Therefore, a need exists for a ballast and de-ballast system that solves the above and other problems.

SUMMARY

It was determined that by using either fresh (potable) or salt water as ballast along with the ballast water system of the present disclosure, it is possible to achieve an operationally feasible, convenient, cost effective, and regulatory compliant solution for managing ballast water exchange. These and other benefits of the present ballast and de-ballast system and methods will be further appreciated in the following paragraphs.

An aspect of the present disclosure is to provide a ballast and de-ballast system for an articulated tug barge (ATB) or integrated tug barge (ITB). The system includes a tug ballast tank located on the tug, the tug ballast tank being configured to hold ballast water. The system also includes a barge trim tank located on the barge, the barge trim tank being configured to hold tug ballast water. The system further includes at least one umbilical line connecting the tug ballast tank to the barge trim tank. The system is configured to transfer ballast water between the tug ballast tank and the barge trim tank via the at least one umbilical line.

Another aspect of the present disclosure is to provide a ballast and de-ballast system on a tug. The system includes a tug ballast tank located on the tug, the tug ballast tank being configured to hold ballast water. The system further includes one or more pumps configured and arranged to pump water into and out of the tug ballast tank into and out of a barge trim tank located on a barge, the barge trim tank being configured to hold ballast water. The system also includes one or more valves configured and arranged to control a flow of water into and out of the tug ballast tank. The system further includes at least one umbilical line configured to fluidly connect the tug ballast tank to the barge trim tank to transfer ballast water between the tug ballast tank and the barge trim tank.

A further aspect of the present disclosure is to provide a method of ballasting and de-ballasting a tug in an articulated tug barge (ATB) configuration. The method includes ballasting or de-ballasting the tug by transferring water via a closed loop network between a tug ballast tank located on the tug and a barge trim tank located on the barge.

BRIEF DESCRIPTION OF THE DRAWINGS

The present disclosure, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention.

DETAILED DESCRIPTION

Typical ballast operation on an ATB tug involves compensating for fuel consumption or fuel addition by transferring ballast water to or from the tug ballast tank(s). This operation is intended to maintain the tug's displacement or relative position of the tug to the barge throughout a voyage. A small to medium size tug will consume approximately 25 to 35 tons of fuel in a day at charter speed. For illustrative purposes, this means that an equivalent amount of ballast water is required to be taken onboard the tug to compensate for the fuel consumed. This ballast water transfer is typically done once or twice a day depending on vessel rate of fuel consumption and vessel routine.

The ballast water systems according to embodiments of the present disclosure provide an operationally convenient, cost effective, and regulatory compliant closed loop water ballast system that meets the unique operational requirements of an ATB tug. According to embodiments, the ATB tug does not discharge any ballast water to the sea but compensates the fuel consumption by transferring the ballast to/from the trim tank on the barge to the ballast tank or tanks on the tug.

Figure 1A:
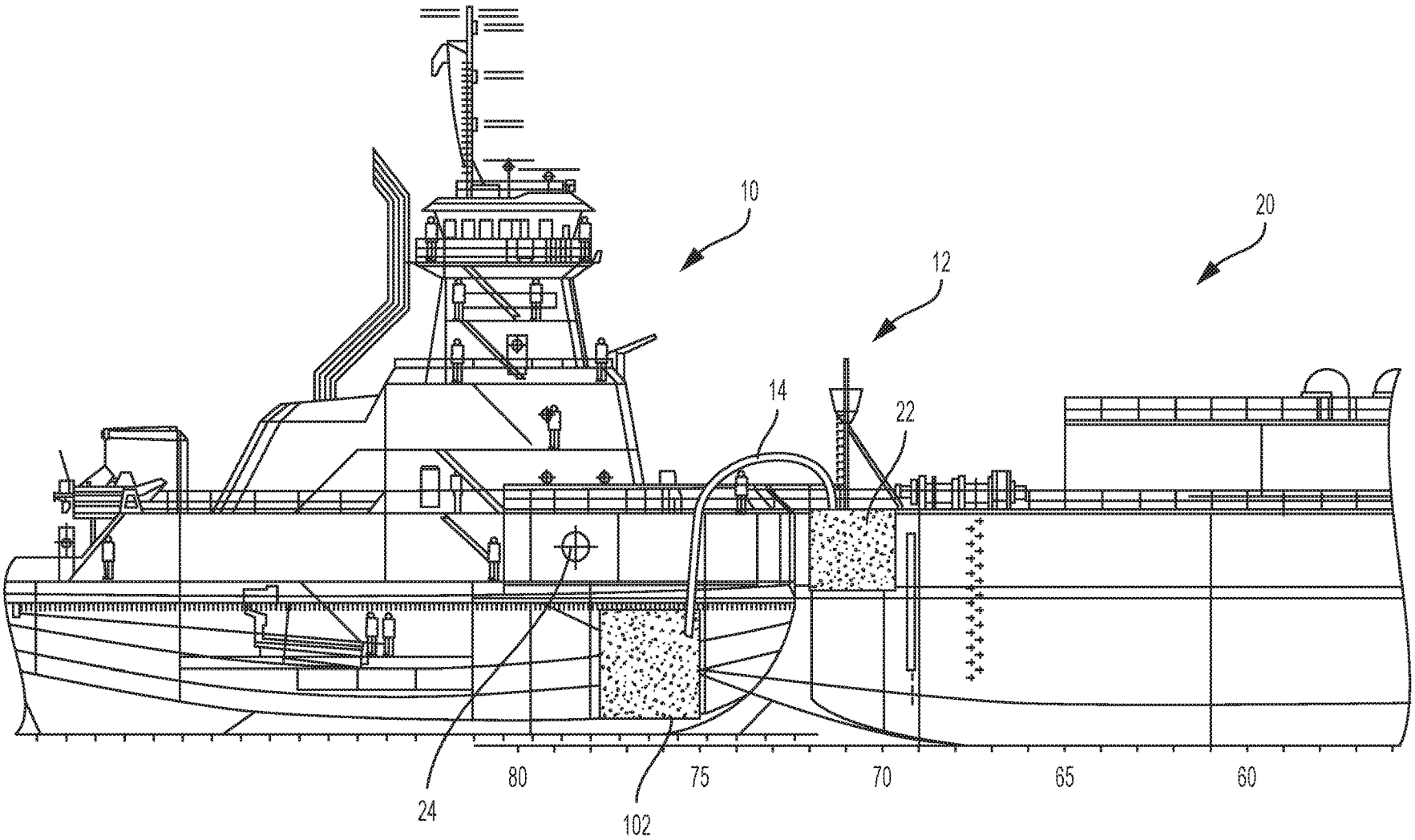
FIG. 1A is a lateral view of a portion of an articulated tug and barge (ATB) showing the coupled arrangement between the tug and barge and the relative location of the ballast tank(s) on a tug and the expansion or trim tank on a barge, according to an embodiment of the present disclosure.
Figure 1B:
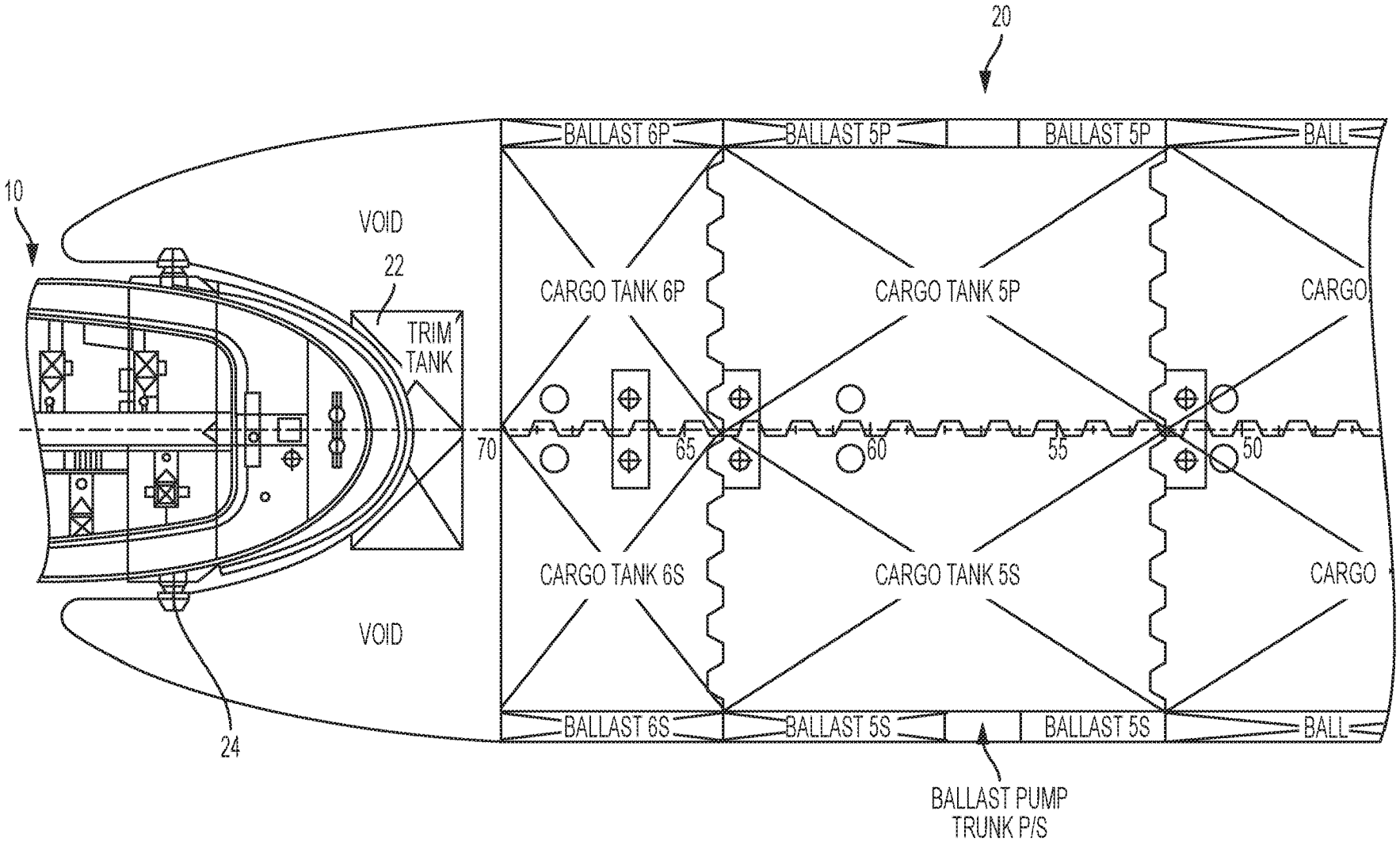
FIG. 1B is a top view of the ATB showing the coupled arrangement between the tug and barge, and a position of the trim tank on the barge, according to an embodiment of the present disclosure.

FIG. 1A is a lateral view of a portion of an articulated tug and barge (ATB) showing the coupled arrangement between the tug and barge and the relative location of the ballast tank(s) on a tug and the expansion or trim tank on a barge (referred to herein interchangeably), according to an embodiment of the present disclosure. FIG. 1A provides an overview of an articulated tug and barge "closed loop" ballast system, according to an embodiment of the present disclosure. The ballast system 12 can include one or more trim tanks 22 on the barge 20, and one or more tug ballast tanks 102 on the tug 10. For simplicity, the application will refer to one trim tank 22 and one tug ballast tank 102, although more than one of each tank is possible. FIG. 1B is a top view of the ATB showing a position of the trim tank 22 on the barge 20, according to an embodiment of the present disclosure. As shown in FIG. 1A, the tug 10 has the tug ballast tank 102 configured to provide stability to the tug 10 by compensating for fuel consumed by the tug. The barge 20 has its own ballast system (not shown). However, in addition to its own ballast system, the barge 20 is also provided with the trim tank 22. In an embodiment, the trim tank 22 on the barge 20 is not connected to the barge ballast system (not labelled). That is, according to embodiments, the trim tank 22 is not in fluid communication with any ballast tank on the barge. The trim tank 22 can be connected to the tug ballast tank 102 by one, two, or more umbilical lines (including water lines)14. The umbilical line(s) 14 connect the fixed piping network on the barge 20 with the fixed piping network on the tug 10 and provides for a safe emergency de-coupling of the tug from the barge. In an embodiment, a combined capacity of the tug ballast tank(s) 102 is in the range of 150 $m^3$ to 700 $m^3$ (for example, between 350 $m^3$ and 450 $m^3$). In an embodiment, the trim tank(s) 22 have a similar capacity as the combined capacity of the tug ballast tank(s) 102. In an embodiment, the tug ballast tank 102 has sufficient capacity to meet the stability criteria established for the tug 10. In an embodiment, the barge trim tank 22 has sufficient capacity to meet the ballasting requirement for the tug 10, i.e., to provide sufficient ballast water to the tug ballast tank 102.

The tug 10 can de-ballast, i.e., transfer water from the tug ballast tank 102 into the trim tank 22 on the barge 20 before a bunkering operation (i.e., refueling operation) of the tug 10 for filling the fuel reservoir of the tug 10. The tug 10 can also take ballast water from the trim tank 22 on the barge 20 to fill the tug ballast tank 102 while in-transit as fuel in the fuel reservoir of the tug 10 is consumed. In this way, the load on the articulating pin 24 (see FIG. 1B) that connects the tug 10 and barge 20 can be kept constant.

In an embodiment, the ballast water on board the tug 10 could be either fresh potable water from the U.S. or Canada sources or sea water. Therefore, the likelihood of pollution can be eliminated because the water ballast is self-contained onboard much like a land based transfer system.

Figure 2:
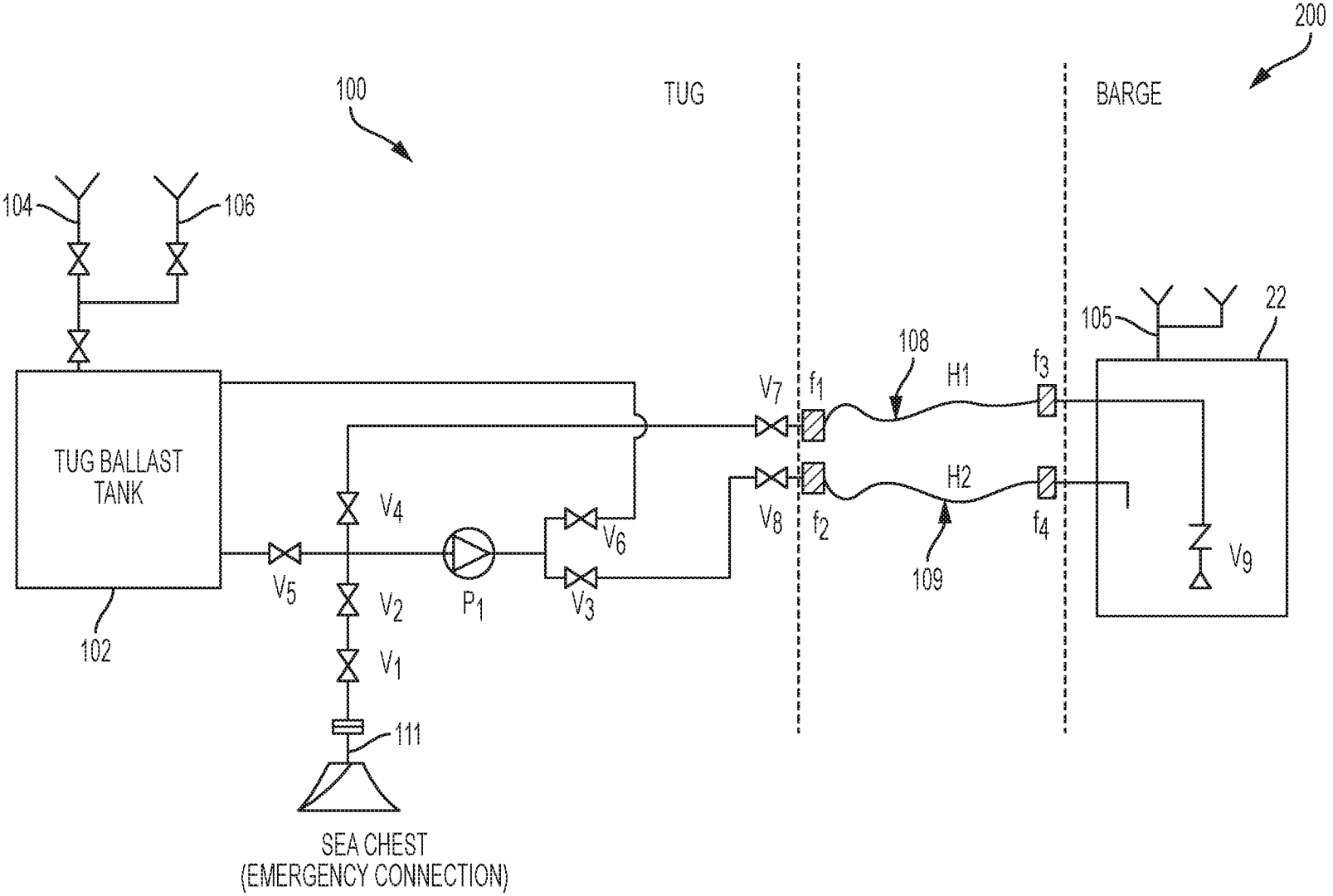
FIG. 2 is a fluid line diagram showing the "closed loop" arrangement of a ballast and de-ballast system, according to an embodiment of the present disclosure.

FIG. 2 is a fluid line diagram of the ballast and de-ballast system, according to an embodiment of the present disclosure. Portions of the system located on the tug 10 and portions of the system located on the barge 20 are separated by dotted lines. A portion 100 of the fluid line diagram depicts components located on the tug 10, and a portion 200 of the fluid line diagram depicts components located on the barge 20. That portion of the system interconnection between the tug system 100 and barge system 200 is referred to as the umbilical line or connection 108 and umbilical line or connection 109, according to an embodiment of the present disclosure. In an embodiment, umbilical connection 108 includes fittings F1 and F3 and hose H1 and umbilical connection 109 includes fittings F2 and F4 and hose H2. Various valves labeled by "V" (for example, valves V1 through V9) and one or more pumps labeled by "P" (for example, pump P1) are provided for controlling the flow of water between the barge trim tank 22 and tug ballast tank 102. In an embodiment, the pump(s) P1 and the valves V1 through V8 are located on the tug, except the "Foot Valve" V9 which is located inside the barge trim tank 22. In an embodiment, the pump P1 is a marine, class approved centrifugal pump with flow rate between 25 $m^3$/hr to 75 $m^3$/hr, depending on the ATB tug size and requirement.

In an embodiment, initially, the tug 10 has no or very limited fuel bunkers (i.e., no or very limited fuel in the fuel reservoir) on board. Therefore, the tug ballast tank 102 is filled substantially 100% with ballast water via water filling line 104 to offset the lack of fuel onboard. For tugs operating in frigid climates, antifreeze may be added to either the tug ballast tank 102 via antifreeze line 106 or to the barge trim tank 22 via antifreeze line 105 to preclude potential freezing of the ballast water. Initially, the trim tank 22 on the barge 20 would be essentially empty (i.e., is not filled with water). In an embodiment, a combined capacity of the tug ballast tank(s) is in the range of 150 $m^3$ to 700 $m^3$ (for example, between 350 $m^3$ and 450 $m^3$). In an embodiment, the trim tank(s) 22 has a similar capacity as the combined capacity of the tug ballast tank(s) 102.

In order to initiate a fuel bunkering operation, i.e., refueling the tug 10 with fuel, the tug 10 generally disengages from the barge 20. The ballast water in the ballast tank 102 of tug 10 is transferred from the tug 10 to the trim tank 22 of the barge 20 before the tug 10 proceeds to the fuel dock for bunking (refueling). This event is commonly referred to as de-ballasting the tug 10.

When the ATB (with the tug 10 and barge 20 linked or coupled together), is en-route, the tug 10 will consume fuel and compensate the consumed fuel by taking ballast from the trim tank 22 on the barge 20. More specifically, the ballast system will pump water from the trim tank 22 to the tug ballast tank 102 via the umbilical lines 108, 109.

During de-ballasting, when transferring water from tug ballast tank 102 on the tug 10 to the trim tank 22 on the barge 20, valves V5, V3, and V8 are opened (e.g., manually or automatically) and all remaining valves V1, V2, V4, V6, and V7 are closed (e.g., manually or automatically), and V9 closes (e.g., manually or automatically). The pump P1 is energized and water is pumped from the tug ballast tank 102 on the tug 10 to the barge trim tank 22 on the barge 20 via umbilical line 109. During ballasting, when transferring water from the barge trim tank 22 on the barge 20 to the tug ballast tank 102 on the tug 10, the valves V4, V6 and V7 are opened (e.g., manually or automatically) and V9 opens (e.g., manually or automatically), all remaining valves V1, V2, V3, V5 and V8 are shut (e.g., manually or automatically). The pump P1 is energized and water is pumped from the barge trim tank 22 on the barge 20 to the tug ballast tank 102 of the tug 10 via umbilical line 108. Although one ballast tank 102 is shown, a plurality of tanks 102 can be provided on the tug 10. Similarly, although one trim tank 22 is shown, a plurality of trim tanks 22 can be used on the barge 20.

In an embodiment, emergency de-ballasting operations can be provided, as a requirement of the regulations, when the normal transfer of ballast from ballast tank 102 of the tug 10 to the trim tank 22 of the barge 20 is not available because the tug 10 has become separated from the barge 20 and the umbilical cords 108 and 109 are disconnected at the auto break-away disconnect fittings F6 and F9. Emergency de-ballast operations can be accomplished by opening valves V5, V3 and V8, all remaining valves V1, V2, V4, V6 and V7 on tug 10 are closed. Pump P1 can be started and ballast water from ballast tank 102 can be discharged overboard through the deck connection F2.

According to an embodiment, emergency ballasting operation can be provided, as a requirement of the regulations, when the normal transfer of ballast water from the trim tank 22 on the barge 20 to the ballast tank 102 on the tug 10 because the tug 10 has become separated from the barge 20 and or the umbilical cords 108 and 109 are disconnected at the auto break-away disconnect fittings F3 and F4. Emergency ballast operations is accomplished by opening valves V1, V2, and V6. All remaining valves V3, V4, V5, V7 and V8 are closed. Pump P1 can be started and ballast water is drawn in from the sea chest 111 and discharged to tug ballast tank 102.

The present ballast and de-ballast system according to embodiments of the present disclosure adheres to USCG, Environmental Protection Agency, International Maritime Organization, and other state regulations by retaining ballast water on-board (e.g., on board of tug 10 or on-board of barge 20). As a result, the present ballast and de-ballast system provides an operator friendly, cost effective, and environmentally sensitive solution for ballast water management on ATB tugs.

In an embodiment, the trim tank 22 can be placed in a safe area or zone on a barge 20, so as to prevent any contamination of the water inside the trim tank 22 by hazardous materials or the like. In an embodiment, the typical capacity of the trim tank 22 is around 200 to 300 cu-m. In an embodiment, the trim tank capacity is between 250 cu-m and 275 cu-m. In an embodiment, the tug boat 10 has approximately 290 cu-m ballast capacity.

According to embodiments of the disclosure, the TPC (tons per centimeter immersion) or TPI (tons per inch immersion) of the tug 10 and the barge 20 are significantly different so that the movement of water between the tug 10 and the barge 20 will not create further load imbalance on the articulating pin 24. TPC and TPI values indicate how much weight (in Tons) will be required to sink the tug or barge by 1 cm or 1 inch, respectively. For a typical ATB, the TPI value for the barge is approximately 87 LT/inch and the TPI value for the tug is approximately 9.4 LT/inch.

In an embodiment, the tug 10 can perform ballast and de-ballast operations without any requirement for contamination as it remains within the U.S. territorial waters. However, in an embodiment, if the vessel departs U.S. EEZ with "Full Fuel Tanks," the sea-water intake for ballast tank(s) 102 on the tug 10 is sealed or logged. The trim tank 22 on barge 20 is full with U.S. water. The tug 10 can ballast from the trim tank 22 on barge 20 to compensate for consumed fuel. The tug 10 may debunker in a foreign port.

If the tug 10 has to de-ballast for bunkering, the water will be transferred back to the trim tank 22 on board of barge 20. The tug 10 again ballasts using water from the trim tank 22 during passage until the tug 10 is back in US EEZ. In another embodiment, if the tug 10 departs U.S. EEZ with "Part Empty Fuel Tanks," the sea-water intake for ballast tank(s) 102 on the tug 10 is sealed or logged. The trim tank 22 on the barge 20 is partly full with potable water or U.S. sea water. The tug 10 ballasts to compensate for the fuel using the water in the trim tank 22 on the barge 20. If the tug 10 bunkers in a foreign port, the tug 10 will de-ballast and water will be transferred back to the trim tank 22 on the barge 20. The tug 10 again ballasts using the trim tank 22 during passage until the tug 10 is back in U.S. EEZ.

In an embodiment, during water transfer and ballast and/or de-ballast operations, appropriate Ballast Water Management procedures are implemented to prevent overflow of the tug ballast tank 102 in tug 10 and trim tank 22 in barge 20 to mitigate pollution risks. The procedures include, for example, providing alarms located on ballast tank 102 of the tug 10 and trim tank 22 of barge 20 warning when the tanks have reached a predetermined high level. Additionally, valves V1, V2 can be provided with a fitting with a mechanical locking device preventing inadvertent opening except in emergency conditions as required by the regulations. Furthermore, other Ballast Water Management procedures can also be implemented to prevent ballast water from being discharged to the sea when the vessel is outside U.S. EEZ.

In an embodiment, the umbilical line emergency break away couplings F3 and F4 are self-closing devices to prevent accidental spilling ballast water during an emergency decoupling of the tug 10 from the barge 20. In an embodiment, the tug 10 can also be provided with an emergency source of sea water connection 111 in-case additional ballast water is required during heavy weather and tug 10 has become de-coupled from the barge 20.

The present ballast and de-ballast system has many benefits including ease of use as it only employs few valves and pumps, cost effective in terms of operating and installation expenses, and environmentally sensitive as ballast water is retained in either the ballast tank 102 on the tug 10 or in the trim tank 22 on the barge 20 which precludes ballast water, which may contain invasive species, from being discharged into the sea.

The invention claimed is:

1. A ballast and de-ballast system for an articulated tug barge (ATB) or integrated tug barge (ITB), the ballast and de-ballast system comprising:

a tug ballast tank located on the tug, the tug ballast tank being configured to hold ballast water;

a barge trim tank located on the barge, the barge trim tank being configured to hold ballast water; and at least one umbilical line connecting the tug ballast tank to the barge trim tank;

wherein the ballast and de-ballast system is configured to transfer ballast water between the tug ballast tank and the barge trim tank via the at least one umbilical line, wherein the ballast and de-ballast system is a closed loop water ballast system configured such that the ballast water is retained on-board of the tug or on-board of the barge, or both, and wherein the ballast and de-ballast system is configured to prevent the ballast water from being discharged to sea so as to mitigate pollution risks.

2. The ballast and de-ballast system according to claim 1, further comprising one or more pumps configured to transfer ballast water from the tug ballast tank to the barge trim tank, and from the barge trim tank to the tug ballast tank.

3. The ballast and de-ballast system according to claim 1, further comprising one or more valves configured to control a flow of ballast water from the tug ballast tank to the barge trim tank and a flow of ballast water from the barge trim tank to the tug ballast tank.

4. The ballast and de-ballast system according to claim 1, wherein the tug ballast tank comprises a plurality of water tanks.

5. The ballast and de-ballast system according to claim 1, wherein the barge trim tank comprises a plurality of water tanks.

6. The ballast and de-ballast system according to claim 1, further comprising one or more barge ballast tanks located on the barge, wherein the barge trim tank is isolated from the one or more barge ballast tanks.

7. The ballast and de-ballast system according to claim 1, wherein the ballast and de-ballast system is configured to transfer ballast water from the tug ballast tank to the barge trim tank and from the barge trim tank to the tug ballast tank via the at least one umbilical line.

8. The ballast and de-ballast system according to claim 1, wherein the barge trim tank located on the barge is not in fluid communication with a barge ballast tank on the barge.

9. The ballast and de-ballast system according to claim 1, wherein the ballast and de-ballast system is configured to transfer the ballast water from the tug ballast tank to the barge trim tank and from the barge trim tank to the tug ballast tank to maintain a relative position of the tug to the barge.

10. A method of ballasting and de-ballasting a tug in an articulated tug barge (ATB) or in an integrated tug barge (ITB) configuration, the method comprising:

ballasting or de-ballasting the tug by transferring ballast water via a closed loop network between a tug ballast tank located on the tug and a barge trim tank located on the barge, the closed loop network being configured to prevent the ballast water from being discharged to sea so as to mitigate pollution risks.

11. The method according to claim 10, wherein ballasting the tug comprises transferring water from the barge trim tank to the tug ballast tank.

12. The method according to claim 10, wherein de-ballasting the tug comprises transferring water from the tug ballast tank to the barge trim tank.

13. The method according to claim 10, wherein the ballasting comprises controlling a flow of water from the barge trim tank to the tug ballast tank using one or more valves and using one or more pumps.

14. The method according to claim 10, wherein the de-ballasting comprises controlling a flow of water from the tug ballast tank to the barge trim tank using one or more valves and using one or more pumps.

15. The method according to claim 10, wherein ballasting the tug is performed during consumption of fuel from a fuel reservoir of the tug during operation of the tug.

16. The method according to claim 10, wherein de-ballasting the tug is performed during bunking of the tug.

* * * * *